US005983618A

United States Patent [19]

Bruynell

[11] Patent Number: 5,983,618

[45] Date of Patent: Nov. 16, 1999

[54] APPARATUS, SYSTEMS AND METHODS FOR APPLYING FILLING COMPOUND AND WATER ABSORBING PARTICLES IN A STRANDED CONDUCTOR

[75] Inventor: Timothy B. Bruynell, Anderson, S.C.

[73] Assignee: Pirelli Cable Corporation, Lexington, S.C.

[21] Appl. No.: 09/052,574

[22] Filed: Mar. 31, 1998

[51] Int. Cl.[6] ..... D02G 3/36

[52] U.S. Cl. ..... 57/3; 57/7; 57/8; 57/295; 57/296; 57/297; 118/407; 118/420; 427/117; 427/434.6; 427/434.7

[58] Field of Search ..... 57/3, 7, 8, 295, 57/296, 297, 314; 427/117, 434.6, 434.7; 118/407, 420

[56] References Cited

U.S. PATENT DOCUMENTS

| | | | |
|---|---|---|---|
| 1,576,577 | 3/1926 | Cook . | |
| 1,797,249 | 3/1931 | Truesdale et al. . | |
| 1,861,146 | 5/1932 | Sommer . | |
| 1,993,110 | 5/1935 | Myers, Jr. . | |
| 2,028,158 | 1/1936 | Hodson . | |
| 2,155,980 | 4/1939 | Reichelt . | |
| 3,085,388 | 4/1963 | Ansell et al. | 57/7 |
| 3,218,207 | 11/1965 | Iafrate et al. . | |
| 3,340,112 | 9/1967 | Davis et al. . | |
| 3,512,611 | 5/1970 | Hulak . | |
| 3,589,121 | 6/1971 | Mulvey . | |
| 3,607,487 | 9/1971 | Biskeborn et al. . | |
| 3,646,748 | 3/1972 | Lang . | |
| 3,672,974 | 6/1972 | Tomlison . | |
| 3,710,440 | 1/1973 | Nevin et al. . | |
| 3,745,231 | 7/1973 | Eager, Jr. et al. . | |
| 3,827,225 | 8/1974 | Schoerner . | |
| 3,849,354 | 11/1974 | Strecker et al. . | |
| 3,889,455 | 6/1975 | Portinari et al. . | |
| 3,902,307 | 9/1975 | Schoerner . | |
| 3,923,003 | 12/1975 | Carden . | |
| 4,017,579 | 4/1977 | Roe et al. . | |
| 4,033,800 | 7/1977 | Ollis . | |
| 4,105,485 | 8/1978 | Portinari et al. . | |
| 4,123,894 | 11/1978 | Hughes et al. . | |
| 4,164,245 | 8/1979 | Walling et al. . | |
| 4,197,695 | 4/1980 | Hughes et al. . | |
| 4,205,515 | 6/1980 | Garner . | |
| 4,206,790 | 6/1980 | Walling | 141/250 |
| 4,224,090 | 9/1980 | Garner . | |
| 4,252,583 | 2/1981 | Garner . | |

(List continued on next page.)

FOREIGN PATENT DOCUMENTS

| | | | |
|---|---|---|---|
| 2049263 | 12/1980 | United Kingdom | H01B 13/06 |
| 2164198 | 9/1985 | United Kingdom | H01B 7/28 |

*Primary Examiner*—William Stryjewski
*Assistant Examiner*—Gina Silverio
*Attorney, Agent, or Firm*—Norris McLaughlin & Marcus; L. P. Brooks

[57] ABSTRACT

Apparatus and systems for applying filling compound, such as water blocking compound, and water absorbing powder to a core wire or wires of a stranded conductor or to subsequent layers of a stranded conductor, which are particularly suitable for use with a tubular strander, include a rotatable head, which may be positioned downstream of a wire strander. The core is drawn through a core passage where the filling compound is applied to the core and powder is applied to the filling compound. Strand through passages are provided through the rotatable head, for drawing the strand wires therethrough, without being coated. The strand wires are stranded about the core in a closing die. Preferably, the powder circulation circuit is a closed circuit, enabling recycling of the powder. The powder is preferably fluidized prior to its delivery to the applicator, and is withdrawn from the applicator under a slight vacuum. The rotatable head may include a filling compound applicator section and a powder applicator section, which are connected to each other so that they rotate together. Methods of applying filling compound and water absorbing powder are also described.

40 Claims, 5 Drawing Sheets

U.S. PATENT DOCUMENTS 4,265,686 5/1981 Garner .
4,269,023 5/1981 Garner .
4,273,597 6/1981 Garner et al. .
4,294,870 10/1981 Hufnagl et al. .
4,333,419 6/1982 Hufnagl et al. .
4,366,667 1/1983 Oestreich .
4,366,770 1/1983 Eckstein et al. .
4,406,114 9/1983 Lanier et al. ..... 57/7
4,419,157 12/1983 Ferrentino .
4,435,613 3/1984 Gaubert .
4,484,586 11/1984 McMickle et al. .
4,518,633 5/1985 Walling et al. .
4,563,540 1/1986 Bohannon, Jr. et al. .
4,568,400 2/1986 Patterson, Jr. et al. .
4,645,628 2/1987 Gill .
4,671,611 6/1987 Allemand et al. .
4,703,132 10/1987 Marciano-Agostinelli et al. . 174/23 C
4,707,977 11/1987 Cousin et al. .
4,870,814 10/1989 Chacko et al. .
4,963,695 10/1990 Marciano-Agostinelli et al. . 174/23 C
4,964,363 10/1990 Patel et al. .
4,985,185 1/1991 Mayr et al. .
5,049,593 9/1991 Marciano-Agostinelli et al. ... 523/173
5,160,541 11/1992 Fickling et al. .
5,213,644 5/1993 Phillips et al. .
5,449,408 9/1995 Koaizawa et al. .
5,461,195 10/1995 Freeman et al. .
5,509,097 4/1996 Tondi-Resta et al. .
5,536,528 7/1996 Tanaka et al. .
5,601,646 2/1997 Gardner et al. .

APPARATUS, SYSTEMS AND METHODS FOR APPLYING FILLING COMPOUND AND WATER ABSORBING PARTICLES IN A STRANDED CONDUCTOR

FIELD OF THE INVENTION

The present invention relates to the application of filling compounds in electrical cables and, more particularly, to the application of filling compound and water absorbing particles to a core wire or group of wires in a stranded electrical conductor, prior to stranding of the core wire or wires with strand wires.

BACKGROUND OF THE INVENTION

It is known in the art that when water is present in regions of the insulation structure of an electrical cable, water/chemical trees develop and propagate, causing deterioration of the cable insulation. Regions of localized high electrical stress caused by voids, contaminants and protrusions from the conductor and insulation stress control layers are particularly susceptible. Water present in the spaces between the strands of a multi-stranded conductor significantly accelerates the propagation of water/chemical trees in the insulation. It is therefore desirable to fill all spaces between such wires with a filling compound to minimize or prevent ingress and movement of water in such spaces. See, for example, U.S. Pat. Nos. 4,095,039; 4,104,480; 4,145,567; 3,943,271.

U.S. Pat. No. 5,049,593, assigned to the assignee of the present invention and incorporated by reference herein, describes an improved polymeric filling compound for use in electrical cables. Water swellable particles are admixed with or applied to the surface of the polymeric compound providing a more effective block against the ingress and movement of water. In one example, the filling compound and water swellable powder is applied over a first layer of wires during stranding of the wires. A second layer of wires is stranded over the first layer of wires and the filling compound. The second layer is similarly coated and an outer layer of wires is then stranded over the first two layers of wires and filling compound. A rotating wire cage carrying bobbins of strand wires is used to strand the wires over the previous layer of wires and filling compound.

Tubular stranders, wherein the bobbins of strand wire are arranged linearly within a rotating frame, may also be used to strand wires. They may be preferred because of their speed. To fill the interstices between the wires of a cable stranded by a tubular strander, filling compounds are typically applied to the core wire or wires upstream of the tubular strander. The coated core is drawn through the tubular strander to the closing die guided by rollers on the tubular strander.

As the coated core is drawn through the tubular strander, the filling compound is prone to contamination. It may also lose uniformity, drip from the core wire or be removed from the core wire by contact with portions of the tubular strander. Filling compounds have also been applied to cable cores upstream of a rotating wire cage strander. See, for example, U.S. Pat. No. 3,923,003. Such a system is prone to the same problems described above with respect to the tubular strander.

U.S. Pat. No. 4,406,114 attempts to address the problems associated with the application of filling compound, such as a corrosion inhibitor, to a core wire upstream of a strander, by providing an applicator within the tubular strander, near its downstream end where the core wire is wound with strand wire. The core wire is drawn through the applicator, coated, and immediately wound with one or more strand wires, which is said to avoid dripping, smearing, contamination and premature deformation of the corrosion inhibitor. Since the applicator is within the strander, however, storage tanks for the corrosion inhibitor must be provided within the strander, as well. To refill such tanks, the operation of the strander must be stopped. The stranding operation cannot, therefore, be run continuously.

U.S. Pat. No. 3,085,388 shows a rotating applicator for applying filler compound to a core wire of a stranded conductor, which is located downstream of a tubular strander. Separate passages through the applicator are provided for the strand wires to pass through, uncoated. The strand wires are stranded around the core wire in a die after passing through the applicator. While alleviating certain of the problems associated with applying compound to a core, the patent does not show how to apply a layer of water absorbing particles over the filler compound.

A method and apparatus for coating a core wire or wires with water blocking compound and water absorbing particles, which may be positioned downstream of a strander, would be advantageous.

SUMMARY OF THE INVENTION

A rotating applicator for applying filling compound, which can be a water blocking compound, and water absorbing powder, which, preferably, is water swellable is described, which may be positioned downstream of a strander, such as a tubular strander.

In one embodiment of the invention, an applicator for applying filling compound and water absorbing powder to a core of a stranded conductor includes a rotatable head having an axis of rotation, an upstream end and a downstream end. The head has an axially extending core through passage at the axis for the passage of a core of a stranded conductor through the head. The core passage extends from the upstream end to the downstream end. A plurality of strand wire through passages is radially displaced from the axis for the passage of strand wires through the head. Filling compound conveying means for conveying a filling compound to the core through passage from the exterior of the rotatable head, in order to apply the filling compound to the core as it passes through the core passage, is provided. A water swellable powder conveying means disposed intermediate the filling compound conveying means and the downstream end for conveying water absorbing particles to the core passage in order to apply the powder to the filling compound on the core, is also provided. The means for conveying the filling compound and the means for conveying the powder may be one or more radial passages.

The core passage includes a central chamber with a replaceable outlet die at its downstream end having a diameter for controlling, at least in part, the thickness of a layer of water blocking compound remaining on the core when it is drawn out of the central chamber.

The applicator head may include a first section for the application of filling compound and a second section for the application of water absorbing powder. The first and second sections are connected to each other for rotation together, and are supported by stationary casings.

Preferably, a means for removing unused powder from the core passage, which can be one or more additional radial passages, is also provided. To minimize coagulation of the powder as it is conveyed through pipes and tubes to the powder applicator, it has been found desirable to provide the powder to the core passage at high velocity. However, if the powder maintains its high velocity within the core passage, it may exit the passage without completely coating the water absorbing compound on the core. Therefore, the velocity of the powder is preferably decreased in the core passage in one or a number of ways. For example, the total flow area of the powder input passage or passages conveying powder to the core passage is preferably less than the total flow area of the powder output passage or passages conveying unused powder from the core passage. Preferably, the powder output passages are provided on opposite sides of the powder input passage.

In accordance with another embodiment of the invention, a system for applying water blocking compound and water absorbing powder to a core of a stranded conductor includes the applicator as described above, a source of water blocking compound and a source of water absorbing powder. Preferably, the system includes means for creating a slight vacuum in a portion of the core passage where the powder is applied, to assist in withdrawing excess powder from the core passage. Preferably, water absorbing powder is provided to the core passage at a high velocity and there is a slight vacuum in the passages through which the unused powder is removed. Preferably, the system includes a venturi-type pump which fluidizes the powder as it is conveyed to the applicator. Preferably, the powder is fluidized as it exits the source of powder, as well. The unused powder removed from the applicator is preferably returned to the source of powder for reuse.

In accordance with another embodiment of the invention, a method of applying water blocking compound and water absorbing particles to the interstices of a stranded conductor includes drawing a core through a core passage of a rotating applicator and applying water blocking compound to the core in the core passage. Water absorbing powder is applied to the water blocking compound in the core passage. Meanwhile, a plurality of strand wires is drawn through a plurality of strand passages of the applicator without being coated. The strand wires are then stranded about the core. The core can be a single wire or a plurality of stranded wires.

DESCRIPTION OF THE INVENTION

Figure 1:
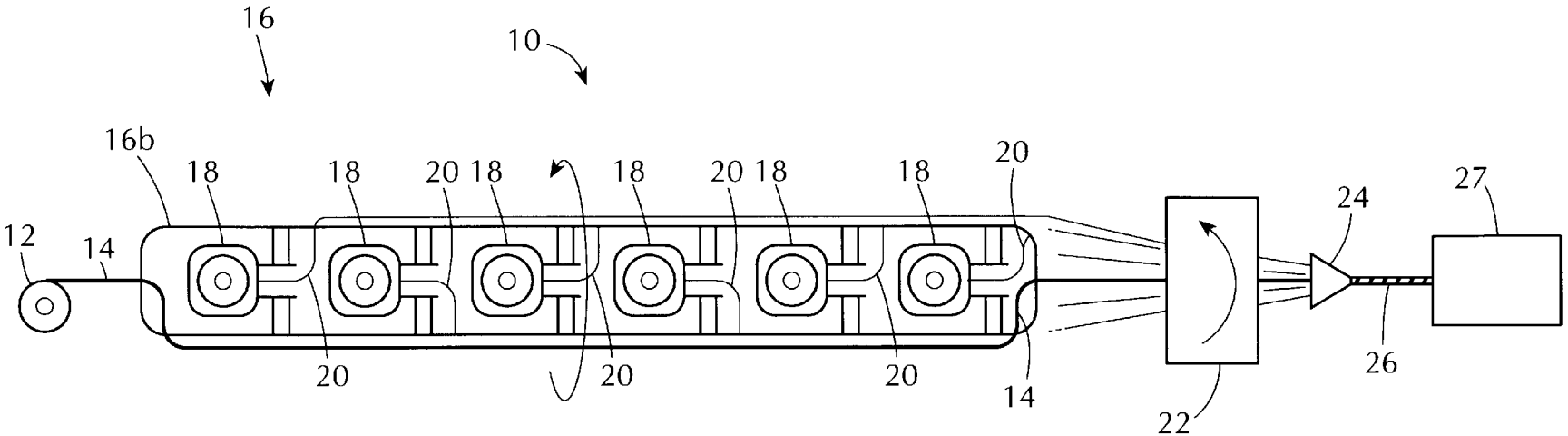
FIG. 1 is a schematic representation of the principal components of a system for applying filling compound in a stranded conductor in accordance with the present invention.

FIG. 1 is a schematic representation of a system 10 for applying filling compound to a core 14 and stranding a layer of strand wires 20 over the core 14, in accordance with the present invention. The core 14 may be a single wire or a plurality of stranded wires. A bobbin 12 contains the core 14, which is not insulated. A tubular strander 16 supports six or more bobbins 18, each providing a strand wire 20, which is also not insulated. The tubular strander 16 rotates as the strand wires 20 are drawn from the bobbins 18. The tubular strander 16 may be any conventional tubular strander known in the art, having a stationary outer frame 16*a* (shown schematically in FIG. 5) and a rotating inner frame 16*b* (shown in FIGS. 1 and 5).

A rotating applicator 22 is provided to apply filling compound to the core 14. The core 14 and strand wires 20 are drawn through the rotating applicator 22, described in more detail with respect to FIG. 2. The rotating applicator 22 and rotating inner frame 16*b* of the tubular strander 16 are driven at the same rate by a common rotating drive shaft 60. The core 14 is drawn from the tubular strander 16 through the drive shaft 60 and into the applicator 22. The core 14 is coated with filling compound, such as water blocking compound and water absorbing powder, in the applicator 22, while the strand wires 20 pass through the applicator 22 uncoated. The coated core 14 and strand wires 22 are then drawn through a closing die 24, where the strand wires 20 are stranded about the core 14 and the assembly of wires is closed to form a tightly stranded conductor 26. The core 14 and strand wires 20 are drawn through the applicator 22 and closing die 24 by a pull-out capstan for collection on a take-up reel, indicated schematically in FIG. 1 as box 27, as is known in the art.

Figure 2:
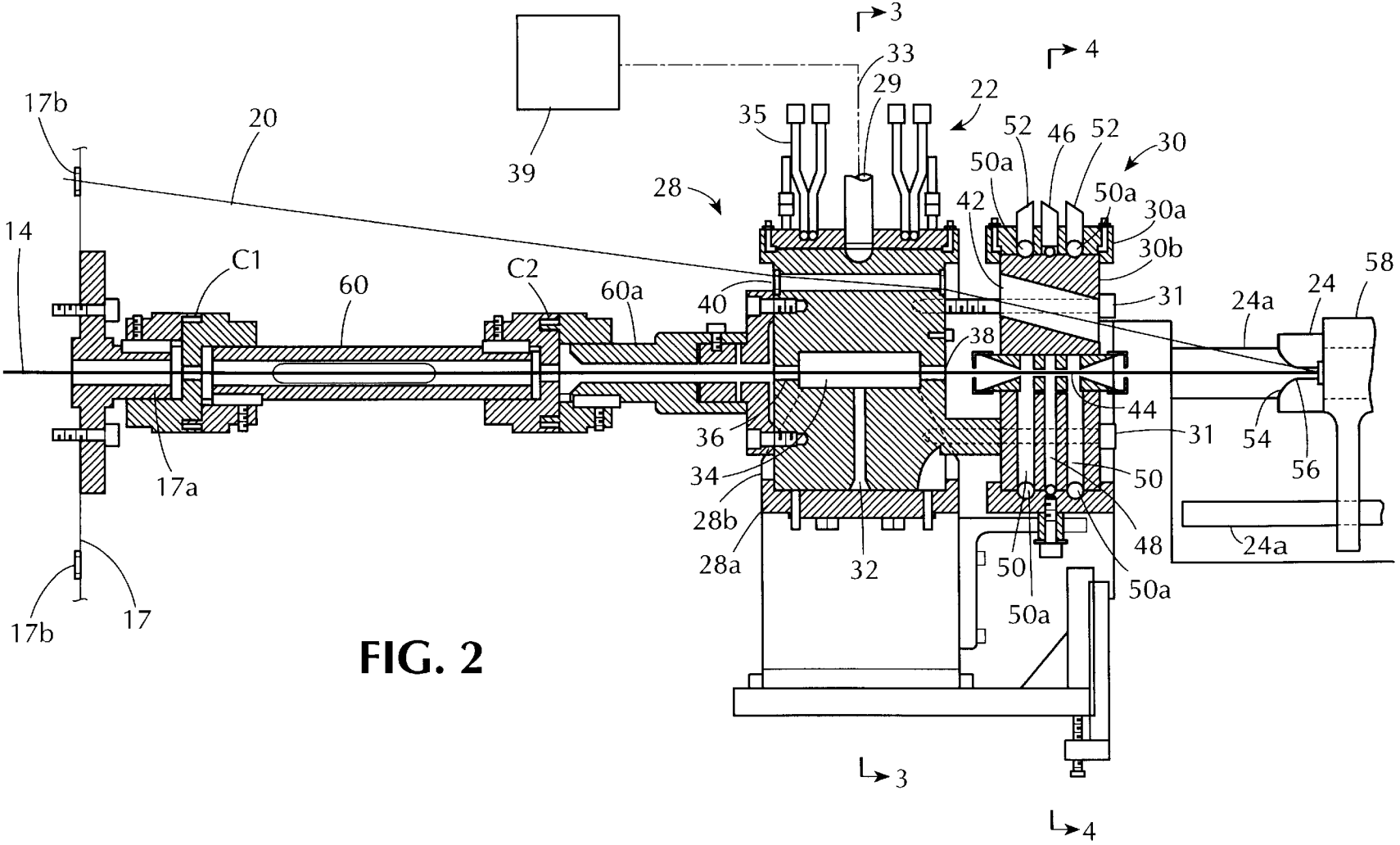
FIG. 2 is a longitudinal cross-sectional view of a rotating applicator in accordance with the present invention and a closing die used in the system of FIG. 1.

FIG. 2 is a longitudinal cross-sectional view of the rotating applicator 22 and cone die 24 of FIG. 1. The rotating applicator 22 in accordance with the present invention includes a water blocking compound applicator ("compound applicator") 28 and a water absorbing powder applicator ("powder applicator") 30. The applicators 28, 30 are supported by the assembly room floor. The two applicators 28, 30 are connected by bolts 31, for example, and therefore rotate together. The bolts 31 in FIG. 2 do not lie in the plane of this cross-section, but are shown in this view for the purpose of illustration.

The front plate 17 of the tubular strander 16 has a shaft portion 17*a*. A shaft portion 60*a* is bolted to the compound applicator 28, as well. Since the rotating inner frame 16*b* "floats" within the outer stationary frame 16*a* of the tubular strander 16, the front plate 17 moves slightly with respect to a stationary casing which supports the rotating applicator 22. To compensate for such motion, the drive shaft 60 is connected to the shaft portion 17*a* of the front plate 17 and to the compound applicator 28 through "spider" couplings $C_1$, $C_2$. The shaft portion 17*d* is connected to one side of the coupling $C_1$. One end of the drive shaft 60 is connected to the other side of the coupling $C_1$. The other end of the drive shaft 60 is connected to one side of the coupling $C_2$. The other side of the coupling $C_2$ is connected to the shaft portion 60*a*. The couplings $C_1$, $C_2$ include openings for the core 14 to pass through. The couplings $C_1$, $C_2$ enable the transfer of rotational motion from the shaft portion 17*a* to the shaft portion 60*a* through the drive shaft 60, despite parallel, angular and axial misalignment of the shafts. The couplings $C_1$, $C_2$ absorb vibration, as well. The couplings $C_1$, $C_2$ may be L190 couplings available from Lovejoy Inc., Downers Grove, Ill., for example.

The core 14 is drawn through the shaft portion 17*a*, drive shaft 60, and shaft portion 60*a*. The strand wires 20 are drawn through openings 17*b* in the front plate 17. One such strand wire 20 is shown being drawn through one hole 17*b*, and the applicator 22.

The compound applicator 28 includes a stationary casing 28*a* and an inner rotating section 28*b* which is rotatably supported by the casing 28*a*. Preferably, a thread type seal is provided between the stationary casing 28*a* and the inner rotating section 28*b*, wherein the outer surface of the inner rotating section in 28*b* has screw threads and the inner surface of the stationary casing 28*a* is smooth. A maximum radial clearance of one thousandth of an inch is preferred.

Figure 3:
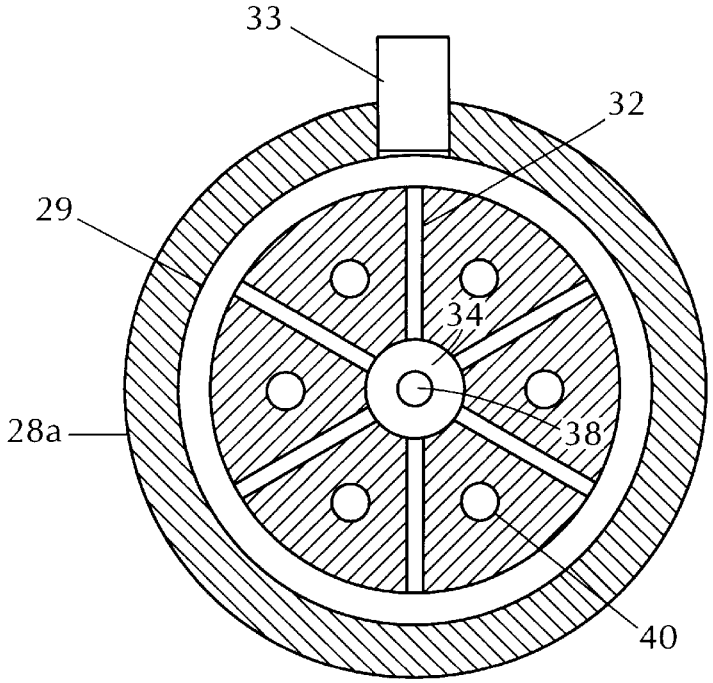
FIG. 3 is a transverse cross-sectional view of the water blocking compound applicator through line 3—3 in FIG. 2.

A circumferential groove 29 is provided between the casing 28*a* and the inner rotating section 28*b*. In the configuration of FIG. 2, the circumferential groove 29 is a peripheral groove formed in the outer surface of the inner rotating section 28*b*. A plurality of passages 32 extends from the peripheral groove 29 to a central longitudinally extending chamber 34 within the rotating section 28*b*. One such passage is shown in FIG. 2. The plurality of passages is shown in FIG. 3, which is a transverse cross-sectional view of the compound applicator 28. The corresponding passage in the top portion of the compound applicator 28, shown in FIG. 3, is not shown in FIG. 2, in order to illustrate the strand passage 40, discussed below. An inlet tube 33 is connected to the circumferential groove 29. Moisture blocking compound is conveyed through the tube 33, to fill the circumferential groove 29. From the circumferential groove 29, the compound passes through the vertical passages 32, to the central chamber 34. Tubes 35 are provided for the circulation of a coolant, such as oil, through the outer casing 28*a*.

A central passage including the central chamber 34 extends through the compound applicator 28. The core 14 is drawn through the central passage. The central chamber 34 has an inlet side with an inlet die 36 and an outlet side with an outlet die 38. The inlet die 36 is replaceable to accommodate cores 14 of differing diameters. The outlet die 38 is also replaceable to accommodate different sized cores and to control the amount of water blocking compound left on the core 14 when it exits the die 38, as discussed below.

A source of filling compound, such as water blocking compound 39, is shown schematically connected to the tube 33. The source 39 is located outside of the compound applicator 28 and may therefore be refilled without stopping the stranding and filling process. The line conveying the water blocking compound to the tube 33 is preferably heated by heat tape, for example. Heat tape or other suitable methods of heating the compound are known in the art.

Strand wire passages 40 extend horizontally through the rotating section 28*b* of the compound applicator 28, to allow the strand wires 20 to be drawn through the compound applicator 28. One such passage is shown in FIG. 2. Preferably, ceramic or carbide guides (not shown) are provided at the entrance and exit portions of the passage. When used in conjunction with the tubular strander 16 shown in FIG. 1, six strand wire passages 40 are provided, one for each of the strand wires 20. If the tubular strander 16 included 12 bobbins of wire to feed 12 strand wires, as is typically the case if a subsequent layer of wires is to be applied to the conductor 26, the compound applicator 28 may include 12 such passages. Alternatively, two adjacent strand wires may be drawn through the same strand wire passage 40.

The powder applicator 30 similarly includes a casing 30*a* and an inner rotating section 30*b* which is rotatably supported by the casing 30*a*. The outer surface of the inner section 30*b* and the inner surface of the casing 30*a* may both be smooth. Strand wire passages 42 extend through the rotating section 30*b* of the powder applicator 30 at an angle directed toward the closing die 24. An angle of about 20° is suitable, for example.

Figure 4:
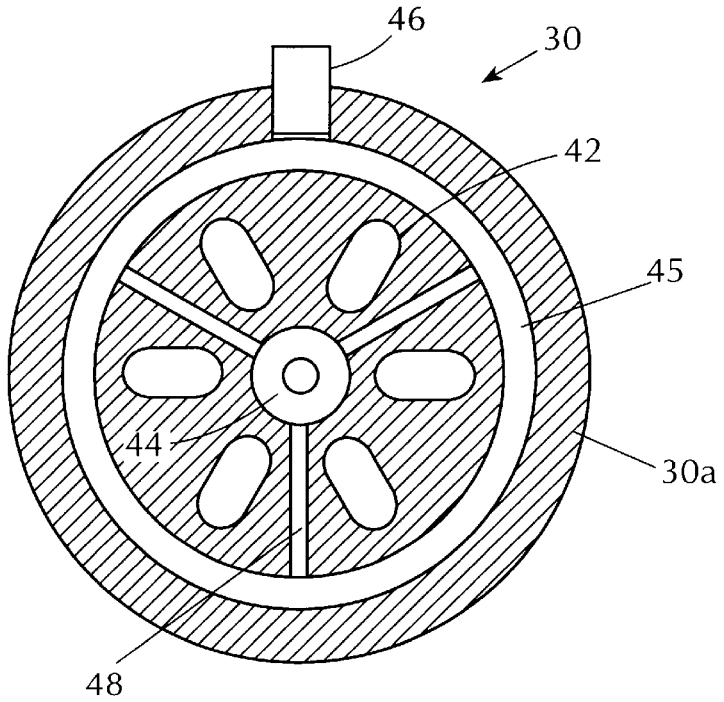
FIG. 4 is a transverse cross-sectional view of the powder applicator through line 4—4 in FIG. 2.

A central passage 44 of the applicator 30 is aligned with the central passage of the compound applicator 28. The core 14 is drawn through the central passage 44. A circumferential groove 45 is provided between the outer surface of the inner rotating section 30*b* and the inner surface of the casing 30*a*, as shown in the cross-sectional view of FIG. 4 through line 4—4 FIG. 2. A plurality of passages 48, one of which is shown in FIG. 2, extends from the circumferential groove 45 to the central passage 44. Three such passages are provided in this embodiment, also as shown in FIG. 4. A tube 46 is in fluid communication with the circumferential groove 45. As in the compound applicator 28, the corresponding passage 48 in the top portion of the powder applicator 30, which is shown in the cross-sectional view of FIG. 4, is not shown in FIG. 3, in order to illustrate the strand passage 42.

A plurality of passages 50, two of which are shown in FIG. 2, also extends from the central passage 44 to two additional circumferential grooves 50*a* formed between the outer surface of the rotating section 30*b* and the inner surface of the casing 30*a*. Preferably, three sets of passages 50 are located on opposite sides of the passage 48 with respect to the central passage 44. The tubes 52 are connected to the circumferential grooves 50*a*. Water absorbing powder is introduced into the applicator 30 through the tube 52, circumferential groove 45, vertical passage 48, and into the central passage 44, where it coats the water blocking compound on the core 14. The powder is removed from the central passage 44 by vertical passages 50, which are under a slight vacuum, the circumferential grooves 50*a*, and the tubes 52.

There must be sufficient clearance between the coated core 14 and the boundaries of the central passage 44 so that the coated core can be drawn through the central passage 44 without the moisture blocking compound and water absorbing powder being wiped off. As in the compound applicator 28, if more than six strand wires are being applied, additional strand wire passages would be provided or adjacent strand wires could be drawn through the same strand passages.

Preferably, the cross-section of the strand passages 42 is oval shaped as shown in FIG. 4. A cross-sectional view of the powder applicator 30 through the tube 52 would be similar to the view of FIG. 4, except that the passages 50 are narrower than the passages 48.

The closing die 24 includes a tapered inlet 54 leading to a cylindrical passage 56 with a substantially constant diameter. The closing die 24 floats on the strand wires 20, as shown in FIG. 2. A closing block 58 secured to supporting rods 24*a* provides a stopping surface limiting lateral movement of the closing die 24, as is known in the art. The diameter of the passage 56 depends on the diameter of the wires and the number of layers of wire in the conductor 26. Closing dies having passages 56 of different sized diameters may be readily interchanged to form conductors having different outer diameters.

Figure 5:
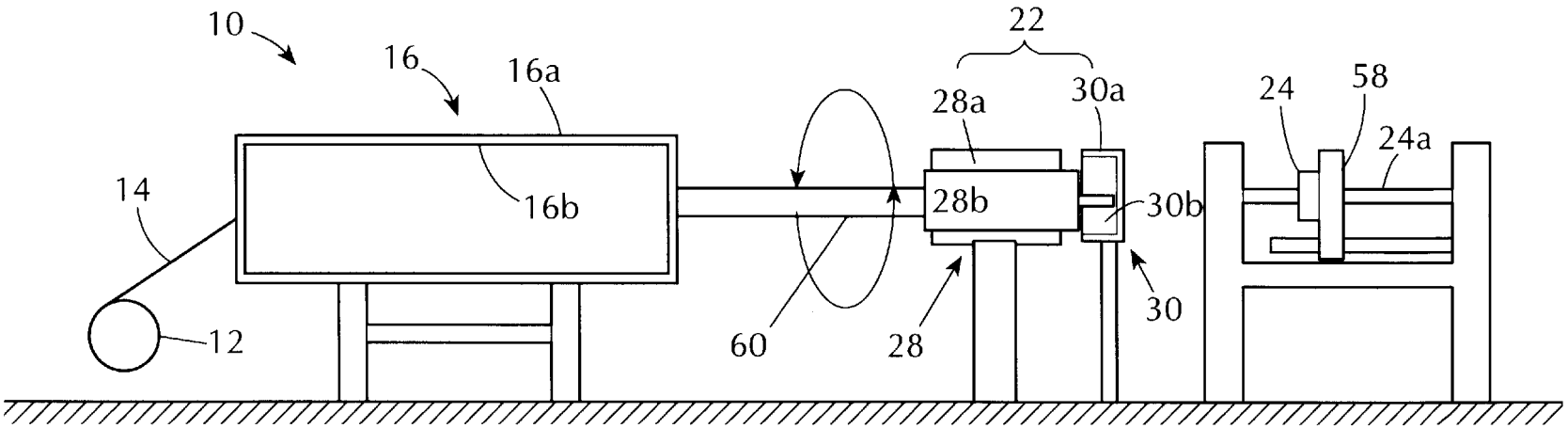
FIG. 5 is a schematic representation of the principal components of the system of the present invention, as they would be arranged on an assembly room floor.

FIG. 5 is a schematic representation of the system 10, as it would be arranged on an assembly room floor. In one configuration, the closing die 24 is from 6 to 10 inches from the exit of the powder applicator 30.

Figure 6:
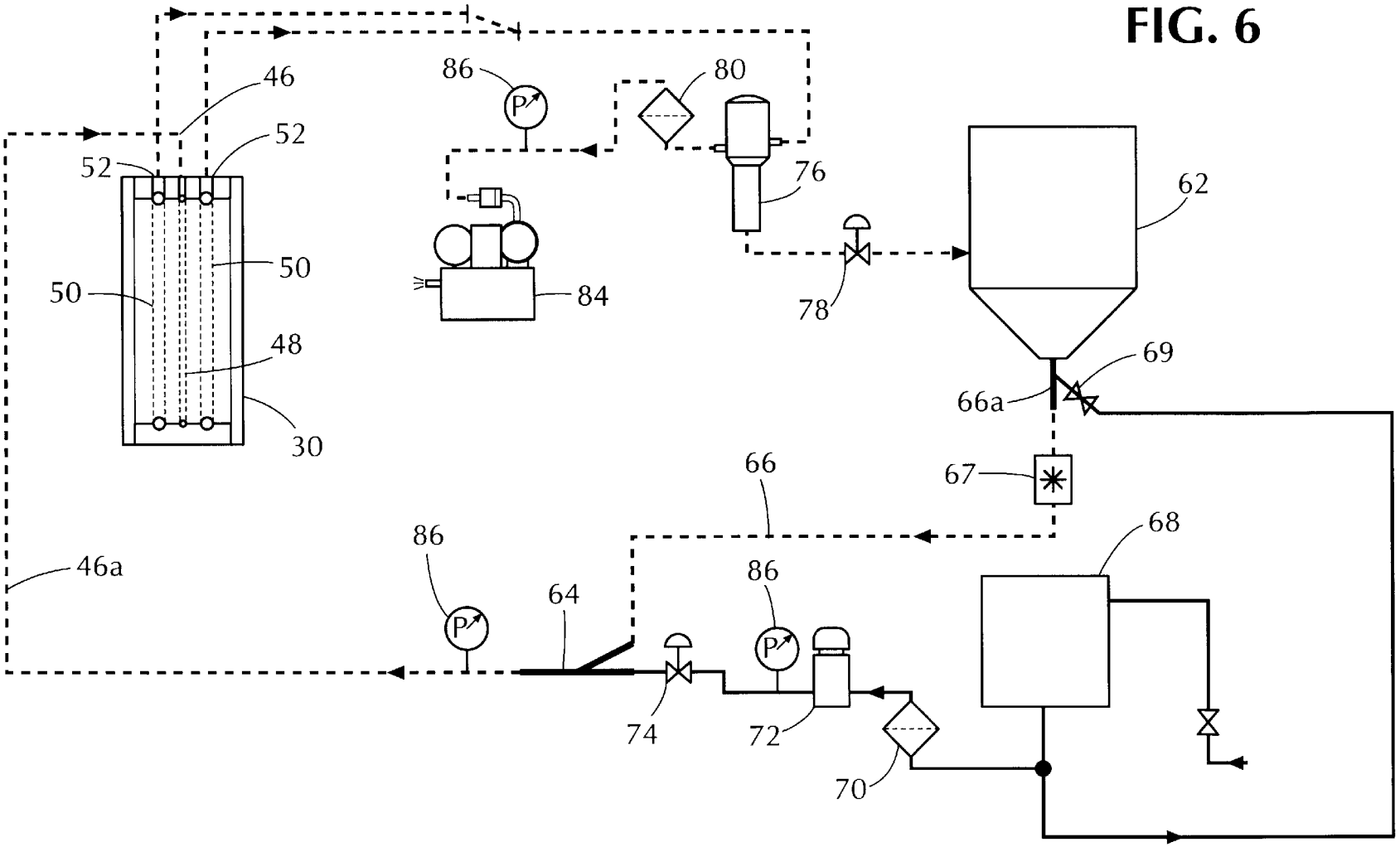
FIG. 6 is a schematic illustration of the circulation circuit for the water absorbing powder.

FIG. 6 is a schematic illustration of a preferred circulation circuit for the water absorbing powder supplied to the powder applicator 30. The powder is stored in a reservoir 62. The powder reservoir 62 is connected to a venturi-type pump 64 through a pipe or pipes 66. A flow meter 67 may be provided along the pipe 66. A portion 66*a* of the pipe 66 extends downward from the reservoir 62. A source of dry air 68 is connected to the portion 66*a* of the pipe 66, proximate the outlet of the reservoir 62, through a valve 69. The angle of the dry air inlet to the pipe 66 is directed away from the direction of the force of gravity, towards the reservoir 62. Preferably, the inlet diameter is also small in relation to the diameter of the pipe portion 66*a*. For example, in one configuration the diameter of the inlet may be ⅛ inch while the inner diameter of the pipe portion 66*a* may be ¾ inch. The valve 69 is a throttling valve, such as a throttling needle valve. The dryer 68 is also connected to the venturi-type pump 64, through an oil filter 70, a regulator 72, and a valve 74.

The output of the venturi-type pump 64 is connected to the tube 46 connected to the powder applicator 30 through a pipe 46*a*. Preferably the pipe 46*a* is stainless steel and the tube 46 is abrasion resistant flexible tubing.

The tubes 52 connect the powder applicator 30 to a dust collector 76, which is connected to the powder reservoir 62 through a valve 78. The dust collector 76 is also connected to an in-line vacuum filter 80, which is connected to a vacuum pump 82.

Pressure gauges 86 are provided in appropriate locations.

During operation, as the tubular strander 16 and applicator 22 rotate, the core 14 and strand wires 20 are drawn through the rotating applicator 22. Water blocking compound is provided to the central chamber 34 of the compound applicator 28 from the tube 33, through the peripheral grooves 29 and passages 32. Water blocking compound is applied to the core 14 as it is drawn through the central chamber 34. Preferably, the water blocking material, which is typically viscous, is provided to the central chamber at a pressure of between about 40–60 psi and a temperature of about 300° F. The diameter of the outlet die 38, the pressure in the central chamber 34 and the temperature of the compound determine the amount of water blocking compound left on the core 14 when it exits the compound applicator 28. Preferably, just enough compound is left on the core 14 to fill the interstices between the core 14 and the strand wires 20 when the strand wires 20 are stranded over the core 14, after the conductor 26 is compressed in the closing die 24.

Powder is conveyed from the powder reservoir 62 to the venturi-type pump 64 under the force of gravity and the vacuum created at the inlet to the pump. An air stream is preferably provided into the portion pipe 66*a* by the source of dry air 68, in a direction generally opposing the force of the gravity, to "puff up" and slightly fluidize the powder. This has been found to minimize coagulation of the powder as it falls towards the venturi-type pump 64, and in the entrance nozzle of the pump 64. The throttle valve 69 is opened just enough to prevent the powder from compacting at the entrance nozzle of the venturi-type pump 64.

The dry air is also provided from the dryer 68 to the venturi-type pump 64, after being filtered by the oil filter 40. The dry air draws the powder from the pipe 66 through a venturi effect, and carries the powder in a fluidized form under high velocity to the powder applicator 30 through the pipe 46*a* and tube 46. Fluidizing the powder and conveying it through the pipe 46*a*, tube 46 and passages 48 at high velocity minimizes problems associated with clumping of the powder and coagulating of the powder against the walls of the pipes and tubes.

The dry air is provided to the venturi-type pump 64 with sufficient pressure, consistent with the pressure versus flow characteristics of the venturi-type pump 64, to maximize the velocity of the powder in the pipes 46*a* and tube 46.

The water absorbing powder conveyed through the tube 46 fills the circumferential groove 45 and the passages 48 and enters the central passage 44. About four times more powder enters the central passage 44 than is actually used. A slight vacuum is preferably created in the central passage 44 to withdraw excess powder from the central passage 44. The vacuum pump 84 is therefore provided to create the slight vacuum in the tubes 52. A vacuum on the order of about 1–2 psi has been found to be sufficient to draw the excess powder out of the central passage 44 without leakage. Since the entrance and exit to the central chamber 44 are not sealed, without such a vacuum, powder would leak out of the central chamber.

To ensure that the powder is not drawn out of the central passage 44 prior to adhering to the central core 14, the vacuum cannot be too high. In addition, it has been found desirable to decrease the velocity of the powder introduced into the central passage 44. Preferably, the cross-sectional area of the passages 48 is therefore less than the cross-sectional area of the central passage 44. As the powder traveling at high velocity through the relatively narrow passages 48 enters the region of high cross-sectional area, its velocity drops. In addition, it is preferred to draw the powder out of the central chamber 44 at two locations on opposite sides of the location where the powder is introduced into the chamber, thereby splitting the powder stream in two directions. It is also preferred that the total flow area of the passages 50 drawing the powder from the central chamber 44 be about four times as large as the total flow area of the passages 48 introducing the powder into the central chamber 44.

The passages 50 convey the powder from the central passage 44 to corresponding circumferential grooves 50*a* in the outer surface of the rotating section 30*b*. The tubes 52 remove the powder from the circumferential grooves 50*a* and applicator 30. The powder is drawn through the dust collector 76 by the vacuum pump 82 and returned to the powder reservoir 62, for reuse. The water absorbing powder circuit is therefore a closed system which enables recycling of the powder, lowering the costs of the process.

As the coated core 14 is drawn through the central passage 44 of the powder applicator 30, it becomes further coated with a thin layer of water blocking powder. Preferably, a single layer of powder about one grain diameter thick is applied. Preferably, the thickness of the grains is in the order of several tens to several hundreds of microns. The grain size distribution of a preferred water blocking powder is given, below.

As the core 14 is drawn through the central chamber 34 and central passage 44, the strand wires 20 are drawn through the strand passages 40 and 42 of the compound applicator 28 and powder applicator 30, respectively, without being coated by water blocking compound or water absorbing powder. As shown in FIG. 2, the strand wires 20 may be drawn through the horizontal strand passages 40 at an angle and may bear against the entrance and exit portions of the strand passages. The ceramic or carbide guides at the entrance and exit provide a hard, smooth, wear resistant surface for the core 14 to bear against. Since in the preferred embodiment the strand passages 42 of the powder applicator 30 are oval shaped and are angled toward the closing die, the strand wires 20 do not bear against any portion of the strand passage 42. Ceramic or carbide guides are not, therefore, necessary. The applicators 28, 30 rotate at the same rate as the tubular strander 16 so that the strand wires 20 pass through the applicators 28, 30 without twisting. In this configuration, the strand wires 20 converge toward the closing die 24 at an angle of about 20°. The strand wires start twisting around the core 14 at the entrance to the passage 56.

The strand wires 20 tightly twist about the core 14 within the passage 20 of the closing die 24. The strand wires 20 are slightly plastically deformed as they are drawn through the passage 20, as is known in the art. As the strand wires 56 are stranded about the core 14, the interstices between the core 14 and the strand wires 56 are filled with the water blocking compound and water absorbing powder.

As mentioned above, a controlled amount of water blocking compound is applied by the applicator 28 to just fill the interstices between the core 14 and the strand wires 20. The portion of the periphery of the strand wires 20 which face the core 14 are in contact with the water blocking compound and water absorbing powder. Essentially no water blocking compound or powder is in contact with the portion of the periphery of the strand wires 20 which does not face the core 14. Water blocking compound or powder on the outwardly facing periphery of the core 14 could interfere with the application of insulating material or layers of other material over the stranded conductor 26, as is known in the art.

If it is desired to apply subsequent layers of strand wires over the strand wires 20, the process of the present invention is repeated, with the stranded conductor 26 formed as described above acting as the core. As is known in the art, if a subsequent layer of wires is to be applied, the first layer is not as tightly closed as it would be if a subsequent layer is not to be applied. Typically, the next layer includes 12 strand wires. A rotating applicator 22 including a compound applicator 28 and a powder applicator 30, as described above, is used, except that the compound and powder applicators have 12 strand passages. The inlet diameter of the inlet die 36 and the outlet diameter of the outlet die 38 would also be larger to accommodate the diameter of the stranded conductor 26 and additional water blocking compound to be applied. The process may be repeated with suitably configured compound and powder applicators in accordance with the present invention, as many times as desired. A tubular strander or a rotating wire cage may be used to apply the subsequent layer of strand wires. If a conductor of multiple layers is to be formed, the powder may optionally be applied only between the outermost layers of strand wires.

Layers of other materials, such as a stress control layer, insulation or an insulation stress control layer, may be applied over the stranded conductor, as is known in the art, to form a complete electrical cable.

Preferably, the filling or water blocking compound comprises a polymer which can be readily pumped at elevated temperatures above 100° C. Normally, this means that the polymer will be a low molecular weight polymer such as low molecular weight polyisobutylene rubber and a low molecular weight copolymer of isobutylene-isoprene rubber. It can be a mixture of ethylene propylene rubber compounded with a substantial amount of carbon black, as described in U.S. Pat. Nos. 4,095,039 and 4,145,567, or other suitable mineral fillers. Other polymers having such characteristics may also be used. A polymer which has been found to be particularly suitable is a low molecular weight L.M. polyisobutylene sold by Exxon Chemical Americas, P.O. Box 3272, Houston, Tex., under the trademark VISTANEX.

If desired the water blocking compound can have water absorbing particles or powders admixed in the compound.

Examples of materials which may be used for the water absorbing powders are polyacrylates and polyacrylamides, either alone or copolymerized with natural polymers such as amides and cellulose and the esters of methyl cellulose and cellulose ethers, such as carboxymethyl cellulose. A material which has been found to be especially suitable is the AQUA KEEP® Type J-550 sodium polyacrylate sold by the Grain Processing Corporation, Muscatine, Iowa.

The manufacturer's literature states that AQUA KEEP® has the following characteristics:

| TEST | TYPICAL DATA |
|---|---|
| Capacity (Dl water) | 500 ml/g |
| Speed (vortex rate) | 3 seconds |
| Capacity (0.9% saline) | 60 ml/g |
| Retention (0.5 psi) | 43 ml/g |
| Volatiles | 6.0% |
| Bulk density | 400 g/l |
| Particle size | |
| on 20 mesh (~850 microns) | 0.0% |
| on 32 mesh (~600 microns) | 5.1% |
| on 80 mesh (~180 microns) | 53.0% |
| on 145 mesh (~106 microns) | 32.1% |
| on 200 mesh (~75 microns) | 6.1% |
| thru 200 mesh | 3.7% |
| pH | 7.2 |
| Residual monomer | 50 ppm |

Water absorbing compounds and water swellable particles are described in more detail in U.S. Pat. No. 5,049,593, assigned to the assignee of the present invention and incorporated by reference, herein.

Although preferred embodiments of the present invention have been described and illustrated, it will be apparent to those skilled in the art that various modifications may be made without departing from the scope of the invention, which is defined in the following claims.

I claim:

1. An applicator for applying water absorbing particles to a core of a stranded conductor prior to stranding wires around the core, said applicator comprising:

a rotatable head having an axis of rotation, an upstream end and a downstream end, said head having an axially extending core through passage at said axis and extending from said upstream end to said downstream end for the passage of the core of the stranded conductor through said head and having a plurality of strand wire through passages radially displaced from said axis for the passage of the strand wires through said head;

filling compound conveying means for conveying a filling compound to said core through passage from the exterior of said rotatable head, for applying said filling compound to said core as it passes through said core passage; and water swellable powder conveying means disposed intermediate said filling compound conveying means and said downstream end for conveying water absorbing particles to the filling compound on the core.

2. The applicator of claim 1, wherein said filling compound conveying means comprises at least one, first radial passage, and said water swellable powder conveying means comprises at least one, second radial passage, said at least one first and second radial passages extending to said core passage.

3. The applicator of claim 2, further comprising a stationary casing, wherein said applicator is rotatably supported by said casing.

4. The applicator of claim 3, wherein said filling compound conveying means and said water swellable powder conveying means further comprise first and second circumferential grooves defined between said casing and said applicator, said first and second circumferential grooves being connected to said at least one first and second radial passages, respectively.

5. The applicator of claim 2, wherein said core passage includes a central chamber wherein said filling compound is applied to said core, said central chamber having an upstream end including an inlet die and a downstream end including an outlet die having a diameter for controlling, at least in part, the thickness of a layer of filling compound remaining on the core when it is drawn out of said central chamber, said first radial passage conveying filling compound to said central chamber.

6. The applicator of claim 5, wherein said strand wire passages have a first, substantially horizontal portion and a second portion angled towards said core passage, from said upstream end towards said downstream end.

7. The applicator of claim 1, further comprising means for conveying unused powder from said core passage.

8. The applicator of claim 7, wherein said means for conveying unused powder from said core passage is at least one, third radial passage, and said at least one second radial passage has a total flow area less than the total flow area of said at least one third radial passage.

9. The applicator of claim 8, wherein there are at least two, third radial passages, one on each side of said least one second radial passage.

10. The applicator of claim 9, wherein the total flow area of said at least two, third radial passages is about four times the total flow area of said at least one, second radial passage.

11. The applicator of claim 1, wherein the rotatable head comprises a first rotatable section including said filling compound conveying means and a second rotatable section including said water absorbing powder conveying means, said first and second sections being connected to each other for rotation together, the core passage and said strand passages extending through said first and second sections.

12. The applicator of claim 11, further comprising a first casing for rotatably supporting said first section and a second casing for rotatably supporting said second section.

13. A system for applying water blocking compound and water absorbing powder to a core of a stranded conductor comprising:

a rotatable head having an axis of rotation, an upstream end and a downstream end, said head having an axially extending core through passage at said axis and extending from said upstream end to said downstream end for the passage of the core of the stranded conductor through said head and having a plurality of strand wire through passages radially displaced from said axis for the passage of strand wires through said head;

filling compound conveying means for conveying a filling compound to said core through passage from the exterior of said rotatable head, for applying said filling compound to said core as it passes through said core passage; and water swellable powder conveying means disposed intermediate said filling compound supply means and said downstream end for conveying water absorbing particles to the filling compound on the core;

said system further comprising a source of filling compound connected to said means for conveying filling compound; and a source of water absorbing powder having an output connected to said means for conveying water absorbing powder.

14. The system of claim 13 wherein said rotatable head further comprises a first circumferential groove connected between said source of filling compound and said means for conveying filling compound, and a second circumferential groove connected between said source of water absorbing powder and said means for conveying water absorbing powder.

15. The system of claim 13, further comprising means for removing unused powder from said core passage.

16. The system of claim 15, further comprising means for establishing a slight vacuum in a portion of said core passage where said powder is applied to said core.

17. The system of claim 15, wherein said means for conveying water absorbing powder is at least one, first radial passage extending from said second groove to said core passage and said means for removing water absorbing powder comprises at least two, second radial passages, each one being on an opposite side of said at least one first radial passage.

18. The system of claim 17, further comprising means for providing said water absorbing powder to said at least one first radial passage at a high velocity and means for creating a slight vacuum in said at least one second radial passages.

19. The system of claim 18, wherein said means for providing said water absorbing powder at a high velocity fluidizes said powder.

20. The system of claim 19, wherein said means for providing said water absorbing powder at a high velocity comprises a venturi-type pump between said source of water absorbing powder and said at least one first radial passage.

21. The system of claim 20, further comprising means for fluidizing said powder as it exits said source of powder.

22. The system of claim 17, wherein the total flow area of said at least two, second radial passages is greater than the total flow area of said at least one, first radial passage.

23. The system of claim 15, wherein said means for removing unused powder is connected to said source of powder.

24. The system of claim 13, further comprising a venturi-type pump positioned between said output of said source of water absorbing powder and said rotatable head and a source of air connected to said venturi pump, such that water absorbing powder supplied to said venturi pump is fluidized by air from said source.

25. The system of claim 13, further comprising a bobbin from which said core is drawn and a plurality of bobbins from which said strand wires are drawn, said bobbins being upstream of said rotatable head.

26. The system of claim 25, wherein said plurality of bobbins are supported by a tubular strander, the system further comprising means for drawing said core through said tubular strander and core passage of said rotatable head, and for drawing said strand wires from said tubular strander, through said strand passages.

27. The system of claim 26, further comprising a closing die, and means for drawing said core and said strand wires through said closing die, wherein said strand wires are stranded about said core in said closing die.

28. The system of claim 13, wherein the source of filling compound contains water blocking compound.

29. A method of applying water blocking compound and water absorbing particles to the interstices of a stranded conductor, comprising:

drawing a core through a central passage of a rotating applicator;

applying water blocking compound to said core in said central passage;

applying water absorbing powder to said water blocking compound in said central passage;

drawing a plurality of strand wires through a plurality of strand passages of said applicator without being coated; and stranding said plurality of strand wires about said core.

30. The method of claim 29, further comprising drawing said core through a rotating tubular strander and drawing said plurality of strand wires from said tubular strander prior to drawing said core and said strand wires through said applicator, said rotating applicator rotating at the same rate as said tubular strander.

31. The method of claim 29, wherein each of said strand wires is drawn through separate passages through said rotating applicator without being coated.

32. The method of claim 29, wherein adjacent strand wires are drawn through the same strand passages, without being coated.

33. The method of claim 29, further comprising stranding said strand wires around said core in a closing die.

34. The method of claim 29, wherein the first applying step comprises applying just enough water blocking compound to said core to fill the interstices between said core and said strand wires.

35. The method of claim 29, wherein said core comprises a plurality of stranded wires.

36. The method of claim 29, further comprising repeating said method with said strand wires stranded about said core, as said core.

37. The method of claim 29, further comprising before the stranding step:

providing water blocking compound to a central chamber in a first portion of said central passage from a source of compound through a first passage;

providing water absorbing powder to a second portion of said central passage from a source of powder through a second passage;

creating a slight vacuum in said second portion of said central passage; and withdrawing water absorbing powder from said second portion through a third passage.

38. The method of claim 37, further comprising providing said water absorbing powder to said second portion at a high velocity and providing a slight vacuum in said second passage.

39. The method of claim 38, further comprising supplying said powder withdrawn from said second portion to said source of powder.

40. The method of claim 37, further comprising fluidizing said water absorbing powder prior to providing said powder to said second passage.

* * * * *